US005128848A

United States Patent [19]

Enders et al.

[11] Patent Number: 5,128,848

[45] Date of Patent: Jul. 7, 1992

[54] OPERATING LIGHT

[75] Inventors: Peter Enders, Frankfurt; Jörg Hartge, Darmstadt; Ingo Jaeckel, Hamburg; Reinhard Luger, Offenbach; Géze Ambrus, Hammersbach, all of Fed. Rep. of Germany

[73] Assignee: W.C. Heraeus GmbH, Hanau, Fed. Rep. of Germany

[21] Appl. No.: 501,615

[22] Filed: Mar. 29, 1990

[30] Foreign Application Priority Data

Mar. 31, 1989 [DE] Fed. Rep. of Germany ... 8903955[U]
Mar. 31, 1989 [DE] Fed. Rep. of Germany ... 8903957[U]

[51] Int. Cl.[5] ..... F21V 7/02

[52] U.S. Cl. ..... 362/268; 362/297; 362/299; 362/302; 362/309; 362/332; 362/339

[58] Field of Search ..... 362/804, 293, 268, 297, 362/298, 299, 302, 308, 309, 332, 339

[56] References Cited

U.S. PATENT DOCUMENTS

| | | | |
|---|---|---|---|
| 1,822,076 | 9/1931 | Bauersfeld et al. | 362/298 |
| 2,173,325 | 9/1939 | Alexander | 240/1.4 |
| 2,257,881 | 10/1941 | Jaros | 240/1 |
| 3,255,342 | 6/1966 | Seitz et al. | 240/1.4 |
| 3,494,693 | 2/1970 | Elmer | 353/55 |
| 3,511,983 | 5/1970 | Dorman | 240/41.15 |
| 3,766,377 | 10/1973 | Junginger | 240/41.15 |
| 4,037,096 | 7/1977 | Brendgord et al. | 240/1.4 |
| 4,092,705 | 5/1978 | Hogberg | 362/294 |
| 4,135,231 | 1/1979 | Fisher | 362/269 |
| 4,254,455 | 3/1982 | Neal, Jr. | 362/804 |
| 4,463,410 | 7/1984 | Mori | 362/299 |
| 4,495,552 | 1/1985 | Graff | 362/297 |
| 4,617,619 | 10/1986 | Gehly | 362/804 |
| 4,630,184 | 12/1986 | Ferraro | 362/293 |
| 4,700,278 | 10/1987 | Chew | 362/249 |
| 4,755,916 | 7/1988 | Collins | 362/298 |
| 4,823,246 | 4/1989 | Dilouya | 362/297 |
| 4,937,715 | 6/1990 | O'Shea et al. | 362/804 |

FOREIGN PATENT DOCUMENTS

| | | | |
|---|---|---|---|
| 548441 | 4/1932 | Fed. Rep. of Germany . | |
| 603666 | 10/1934 | Fed. Rep. of Germany . | |
| 847131 | 8/1952 | Fed. Rep. of Germany . | |
| 967102 | 10/1957 | Fed. Rep. of Germany . | |
| 1034116 | 7/1958 | Fed. Rep. of Germany . | |
| 1179164 | 10/1964 | Fed. Rep. of Germany . | |
| 1447075 | 11/1968 | Fed. Rep. of Germany . | |
| 1287032 | 1/1969 | Fed. Rep. of Germany . | |
| 1622028 | 10/1970 | Fed. Rep. of Germany . | |
| 2305666 | 8/1974 | Fed. Rep. of Germany . | |
| 2430587 | 1/1975 | Fed. Rep. of Germany . | |
| 2535556 | 2/1976 | Fed. Rep. of Germany . | |
| 2519426 | 8/1976 | Fed. Rep. of Germany . | |
| 3150195 | 7/1982 | Fed. Rep. of Germany . | |
| 3222501 | 12/1982 | Fed. Rep. of Germany . | |
| 2725428 | 12/1983 | Fed. Rep. of Germany . | |
| 3531955 | 3/1987 | Fed. Rep. of Germany . | |
| 2817903 | 7/1988 | Fed. Rep. of Germany . | |
| 799964 | 6/1936 | France . | |
| 967964 | 11/1950 | France . | |
| WO87/00908 | 2/1987 | PCT Int'l Appl. . | |
| 282209 | 4/1952 | Switzerland . | |
| 337303 | 5/1959 | Switzerland | 362/804 |
| 507638 | 9/1939 | United Kingdom . | |
| 735732 | 8/1955 | United Kingdom | 362/804 |
| 813721 | 5/1959 | United Kingdom . | |
| 1517357 | 7/1978 | United Kingdom . | |

*Primary Examiner*—Ira S. Lazarus
*Assistant Examiner*—Sue Hagarman
*Attorney, Agent, or Firm*—Merchant & Gould, Smith, Edell, Welter & Schmidt

[57] ABSTRACT

Given is an operating light, with one or several spotlights, each with a light source, that is shielded by a counter reflector in the direction of radiation. The stream of light is focused by the counter reflector and a reflector onto an optical system closing off the housing in the direction of radiation. To guarantee a homogeneous illumination of deeper surgical wounds also, the optical system is structured as a Fresnel lens made up of annular prisms that contain a dioptric central region and a catadioptric edge (rim) region. The slope of the flanks and the height of the annular prisms are dimensioned such that the light beams emanating from the Fresnel lens cut the optical axis at a distance that is all the greater the shorter the distance with which the light beams emanate from the Fresnel lens is away from the optical axis.

21 Claims, 7 Drawing Sheets

OPERATING LIGHT

DESCRIPTION

This invention concerns an operating light with one or several spot-lights, each with a light source that is shielded in the direction of radiation by a counter-reflector such that the stream of light is focused by a reflector onto an optical system closing off the housing in the direction of radiation.

Large operating lights with a light source, possibly with a counter-reflector, and with a large reflector, are described, for example, in U.S. Pat. Nos. 4,135,231 or 4,037,096. These lights attain the required freedom from shadows by the reflector having a large diameter, which assumes the size of the entire housing. To be differentiated from these operating lights are those that display several individual spotlights in a convex underside of the light body, as are described, for example, in Germany Patent 847,131 or Germany Patent 2,725,428. It is to these types of operating lights with several individual spotlights or to an individually-usable, single spotlight in a physicians light, or in an auxiliary light, that the present invention relates. Operating lights with several individual spotlights are also called "multiple-eye lights".

There are various proposals for improving the stream of light from an operating light by influencing the light itself, or by optical means in the beam path between the electrical source of light and the exiting light.

Thusly described in U.S. Pat. No. 3,255,342 is a single spotlight in a multiple-eye operating light, wherewith direct radiation from the lamp is prevented by a meniscus mirror-coating of the lamp. All radiation from the lamp is deflected into a cold-light reflector. A large part of the infrared radiation passes through the reflector and the visible light is focused on an optical system closing off the housing for the light in the direction of radiation.

This optical system consists of several disks or coatings, of which one disk or coating reflects or absorbs infrared in the same way. These disks or coatings make the operating light heavy and the hot rays, not carried off, heat the operating light over a long period of operation. Even the infrared-reflecting disks pick up heat over long periods of operation and then irradiate it.

Known from France Patent 967,964 is an operating light having a Fresnel lens that contains only a catadioptric region and displays an adjustable source of light.

Known from Germany Patent 603,666, as well as from Switzerland Patent 282,209, are Fresnel lenses with dioptric and catadioptric regions.

The object of the invention is to further develop an operating light of the initially-mentioned type, such that an almost homogeneous illumination of a deep surgical wound is guaranteed.

This objective, in the case of the operating light of the initially-mentioned type, is met in accordance with the invention from the fact that the optical system includes a Fresnel lens made of annular prisms having a dioptric central region and a catadioptric edge region, and that the annular prisms are configured such that the light beams emanating from the Fresnel lens cut the optical axis at a distance from the Fresnel lens that is all the greater the shorter the distance with which the light beams emanate from the Fresnel lens is away from the optical axis.

The advantages of the invention lie particularly in the fact that the focal point of the different light beams generated by the Fresnel lens lie at a different distance from the Fresnel lens. The light beams generated by the light source(s) and the Fresnel lens are directed such that there results, in a wide range of distances from the Fresnel lens, an approximately parallel cone of light whose light distribution in the region of the surgical wound remains approximately homogeneous even with different working distances. Guaranteed by the invention is a good shading, depth shading and depth illumination of the wound cavity, over a great working depth. The homogeneous distribution of light provides for a constant shadow generation of the working range, which is essential for the work of the surgeon in order to enable stereoscopic vision and, therewith, an estimation of the smallest distances, even in a wound cavity.

Preferably, the reflector is constructed as a flat hyperboloid in order to achieve an extremely flat method of construction. The reflection coating is preferably deposited on a glass body and structured such that it substantially reflects visible light, and on the other hand substantially permits infrared radiation to pass through. In this manner, only visible light is irradiated onto the Fresnel lens. The infrared radiation is eliminated from the working region of the operating light.

In order to compensate for the greater-scattering angle of radiation at the edge of the reflector, of visible light reflected onto the inner surface of the reflector, by an angle that is better directed toward the rim area of the Fresnel lens located thereunder, the reflection coating at the edge (rim) of the reflector is preferably deposited thicker than at the apex of the reflector.

The Fresnel lens in accordance with the invention can be of acrylic glass or similar material that is sprayed on or poured.

Another embodiment of the invention is obtained by a controllable mobility of the hyperboloid reflector unit relative to the Fresnel lens system. Achieved by this mobility is an advantageous focusing capability of the spotlight. Resulting additionally, is a homogenizing of the field of illumination, if, for example, two, three or more individual spotlights of an operating light are defocused by a like amount. The light beams formed by the dioptric and by the catadioptric lens portion of the Fresnel lens then wander by like amounts from or toward the optical axis, having as a consequence either a uniform expansion or narrowing of the field of illumination.

Retained in each case by the lens system in accordance with the invention is the great advantage that, with each adjusted size of the illuminated field of operation, a homogeneous light distribution is also set in deeper-lying regions of the wound cavity. The operating light has a good depth sharpness, without which the position of the operating light need be subsequently corrected as the operation progresses.

Particularly preferred, the Fresnel lens is constructed of a throughpass basic disk that displays in the rim region annular prisms whose vertex rings and flanks point toward the reflector and form the catadioptric region. The basic disk likewise has in its central region annular prisms whose apices are also directed toward the reflector. Placed in the central region, over the basic disk, is a second Fresnel lens whose annular prisms are directed away from the reflector and which, with the opposingly-directed annular prisms of the throughgoing basic disk and an air gap included therebetween, forms the dioptric lens region. The height of the apex rings of the annular prisms of the catadioptric rim region decreases with increasing distance from the optical center axis. The flanks of these annular prisms inclined toward the optical axis become steeper with increasing distance from the optical center axis, while the radially-outward inclined flanks of these annular prisms are less inclined with increasing distance from the optical center axis.

In the air gap of the dioptric central region of the Fresnel lens, the refractive flanks of the lamp-side and light-output-side annular prisms lie opposite to one another. On the lamp side, the refractive flanks lie more toward the horizontal than they fall off on the light-output side. The refractive flanks of the annular prisms of the central region of the Fresnel lens form, with increasing distance to the optical center axis, a growing angle toward the horizontal. Obtained by this dimensioning of the annular prisms is that the center rays of the light beam going out from the Fresnel lens intersect with the optical axis at a different distance from the Fresnel lens and form corresponding focal points, whereby light distribution remains approximately homogeneous over a wider distance range.

Particularly preferred, the lamps, the counter reflector and the reflector form a structural unit which, compared to the Fresnel lens that is rigidly joined with the housing, is arranged in movable fashion. A movement of this structural unit relative to the Fresnel lens results in an enlargement of the field of illumination, so that the surgeon, with an appropriate movement, can homogeneously illuminate an enlarged field of operation.

Other particulars, features and advantages of the present invention are obtained from the following description of the drawing.

Figure 1:
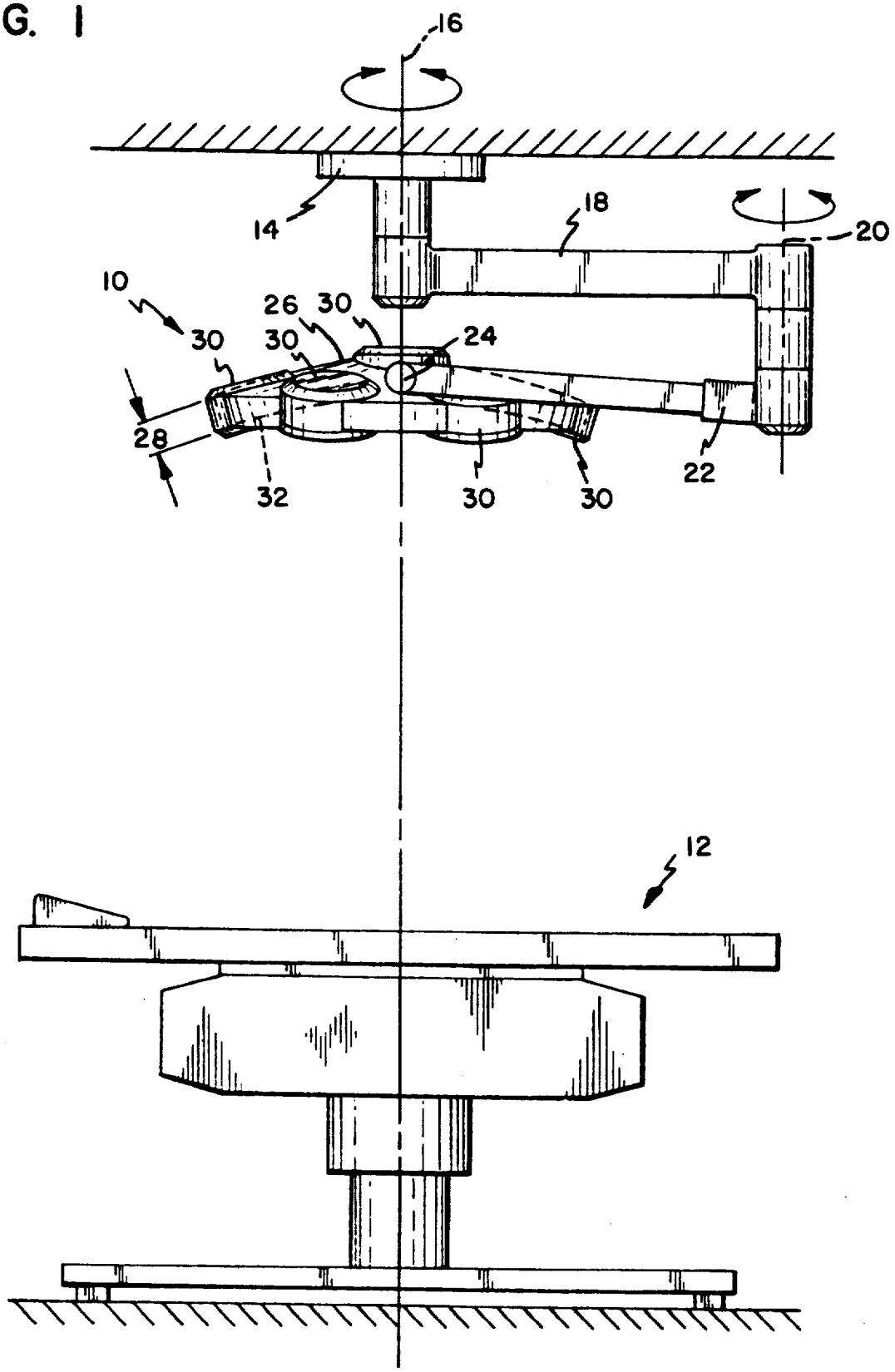
FIG. 1 shows a schematic representation of the arrangement of a new operating light above an operating table.

In accordance with the overview representation in FIG. 1, an operating light 10 is suspended in customary fashion above an operating table 12 by means of a ceiling attachment 14, individually as represented, or in combination with other, same, larger or smaller, operating lights. The suspension is formed by a swivel joint 16, about whose axis the light 10 can be swung by at least 360°. In a manner known per se, the suspension for the light further consists of several arms that are joined together by means of links. Hence, connecting to the link 16 is an arm 18 and to this arm 18, via a double link 20, an arm 22 is linked and capable of being swung about its longitudinal axis, and that arm 22 carries, via an axle 24, a member 26 of the operating light 10. The member 26, compared to customary operating lights, is held very flat with a slight extension 28. In conformance with the applicable state of the art of multiple-eye operating lights, the member 26 has a lower closure 32 in which the light outputs from individual spotlights 25 are located in an area that is arched in sphere-section fashion.

An operating light of the type described, can display one to seven individual spotlights 25, as will be described in more detail below with the aid of FIG. 2. Inside the member 26, each individual spotlight 25 is accessible from the top side, i.e. from the side lying opposite to the light-radiating side of the member 26, after removing a detachable cover 30, which considerably simplifies replacing light sources 50, carrying out maintenance, cleaning, adjusting, etc.

According to FIG. 2, each individual spotlight 25 displays a closed underside 34 that carries a Fresnel lens 60 in a rigid skirting, described in more detail later. Produced via a releasable attachment 36 is a connection to a carrier 38 that passes over into a flanged opening 40 in which a reflector system 42 with light source can move.

The reflector system 42 consists of a carrier 44 in whose center is located an adjustable mounting 46 for a light source 50, preferably a halogen lamp. The mounting 46 is removable from the carrier 44 for replacing the light source 50. Brought out from the mounting 46 are flexible electrical connections.

The total radiation emanating from the light source 50 is hampered from direct irradiation in the direction toward the covering disk, structured as a Fresnel lens 60, by a counter reflector 52, and is reflected back. In this manner, the preponderant portion of the radiation going out from the light source 50 strikes against a principal reflector 54. This principal reflector 54 consists of glass and, in the form of embodiment represented, is a hyperboloid. A hyperboloid reflector has the advantage of being low and is easily produced from glass. The reflector 54 is smaller in diameter than the light output area of the Fresnel lens 60. Since, however, the amount of light is collected via the smaller reflector 54, a high degree of depth illumination in the operating field results, which is desirable and advantageous.

Deposited on the inner side of the reflector 54, which becomes thicker toward the rim 51, is a reflection coating 53 that is substantially pervious for infrared radiation and, which reflects the visible radiation toward the Fresnel lens 60, as is described in more detail in the following. The thickness of the reflection coating 53 increases toward the rim of the reflector 54.

The beam generated by a coil 66 in the light source 50 can first be filtered in the shell or wall of the light source 50. However, since a halogen lamp 50 emits a large component of infrared radiation that radiates either directly, like a ray 68 from the coil 66 toward the reflector 54, or strikes, via the counter reflector 52, like a ray 78, against the reflector 54, the reflection coating 53 is constructed as a conversion filter. While rays 68 are substantially (approximately 70%) deflected as visible light rays 70 in the direction of the Fresnel lens 60, infrared rays 72 do pass through and are diffusedly distributed on the back side of the reflector 54 by a coating 57. This diffuse distribution of the infrared rays 72, that pass through on the back side of the reflector 54, brings about that the heat rays will not strike in beam fashion any components in the member 26 and heat them. Rather, it results in an arbitrary scattering that distributes itself all over. Located in the center of the reflector 54 is an opening 59 wherethrough is accomplished not only the equipping with a socket for the lamp 50, but also through which portions of infrared rays are led away from the reflector system 42.

Another measure for filtering out undesired heat radiation and for generating a cold light in the operating field is represented by the arrangement of a filter disk 56 (FIG. 2) at the lower edge of the reflector 54. Advantageously, we are dealing with an annular disk that is supported only with its radially external rim, and needs no mechanical connection to the hot center made up of light source 50 and counter reflector 52. Heating by thermal flow is avoided. The infrared radiation occurring is reflected back upwardly at an angle that is directed essentially toward the opening 59. In one practical example of embodiment, the largest, optically-effective diameter of the Fresnel lens 60 comes to 190 mm, and the diameter of the reflector 54 is about 120 mm in the optically effective region. The distance from the lower rim of the reflector 54 to the center plane of the Fresnel lens 60 now amounts to 37.7 mm. In another larger, practical example of embodiment, the largest optically effective diameter of the Fresnel lens 60 amounts to about 250 mm and the optically largest diameter of the reflector lies at about 120 mm. Here, the distance from the lower rim of the reflector 54 to the center plane of the Fresnel lens 60 amounts to 70 mm.

In accordance with these two practical examples, subsequently used can be the same reflector unit with a reflector output opening of about 120 mm and an apex height of only about 20 mm for different sizes of individual spotlights, which lowers the manufacturing costs.

The circular-shaped Fresnel lens 60 forming the light output is larger in diameter than the reflector 54 and consists of a dioptric central region and of an annular catadioptric rim region, which is best brought out in FIG. 5.

The light-output-side, lower part of the Fresnel lens 60, consists of a part 61 passing over the entire diameter, which, in the rim region 62 represents the sole catadioptric lens system, while in the central region 64 another Fresnel lens 63 is put on and inserted for the purpose of achromatizing.

Figure 3:
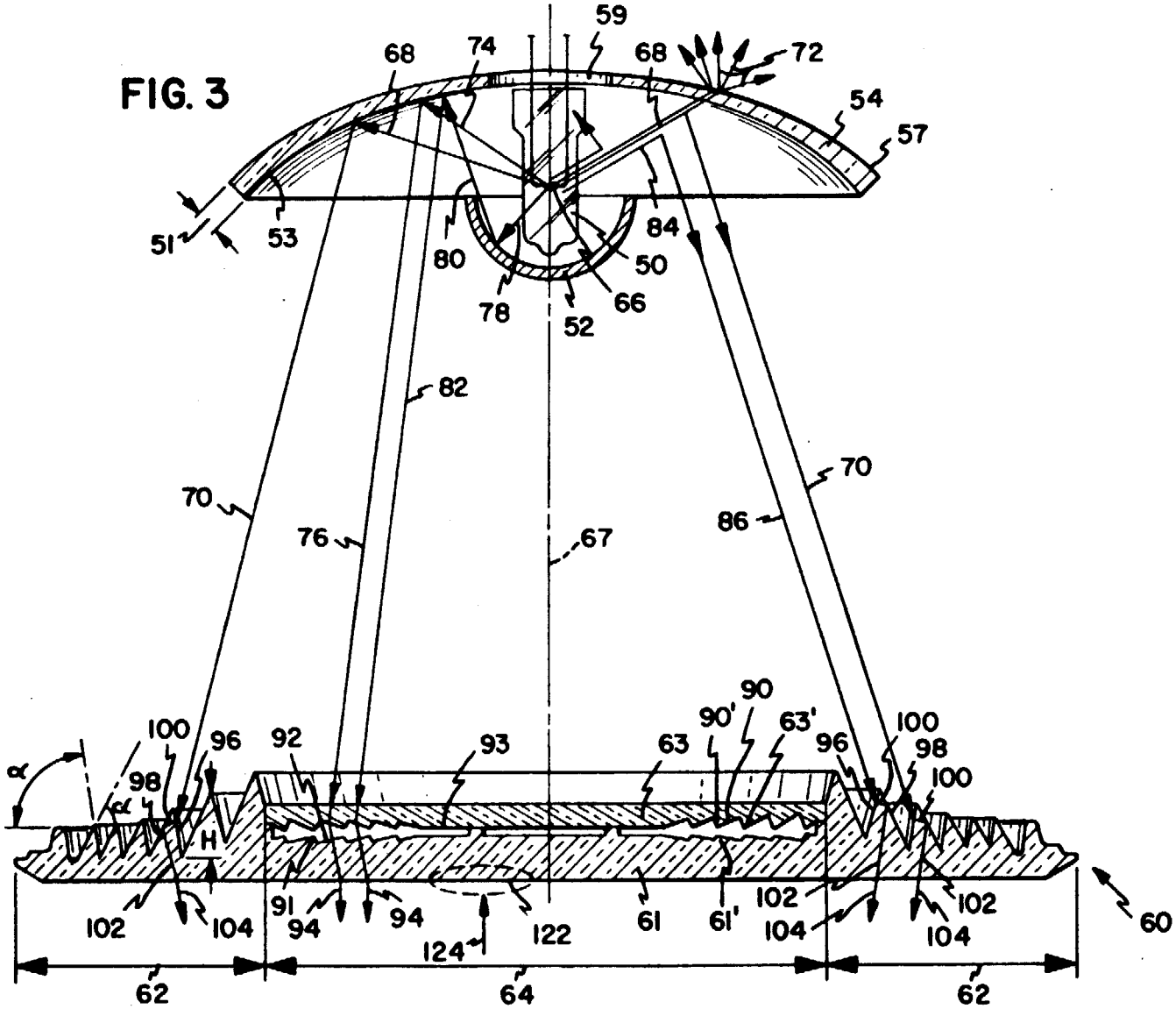
FIG. 3 shows a representation of the main radiation conduction of a light source by the individual spotlight.
Figure 4:
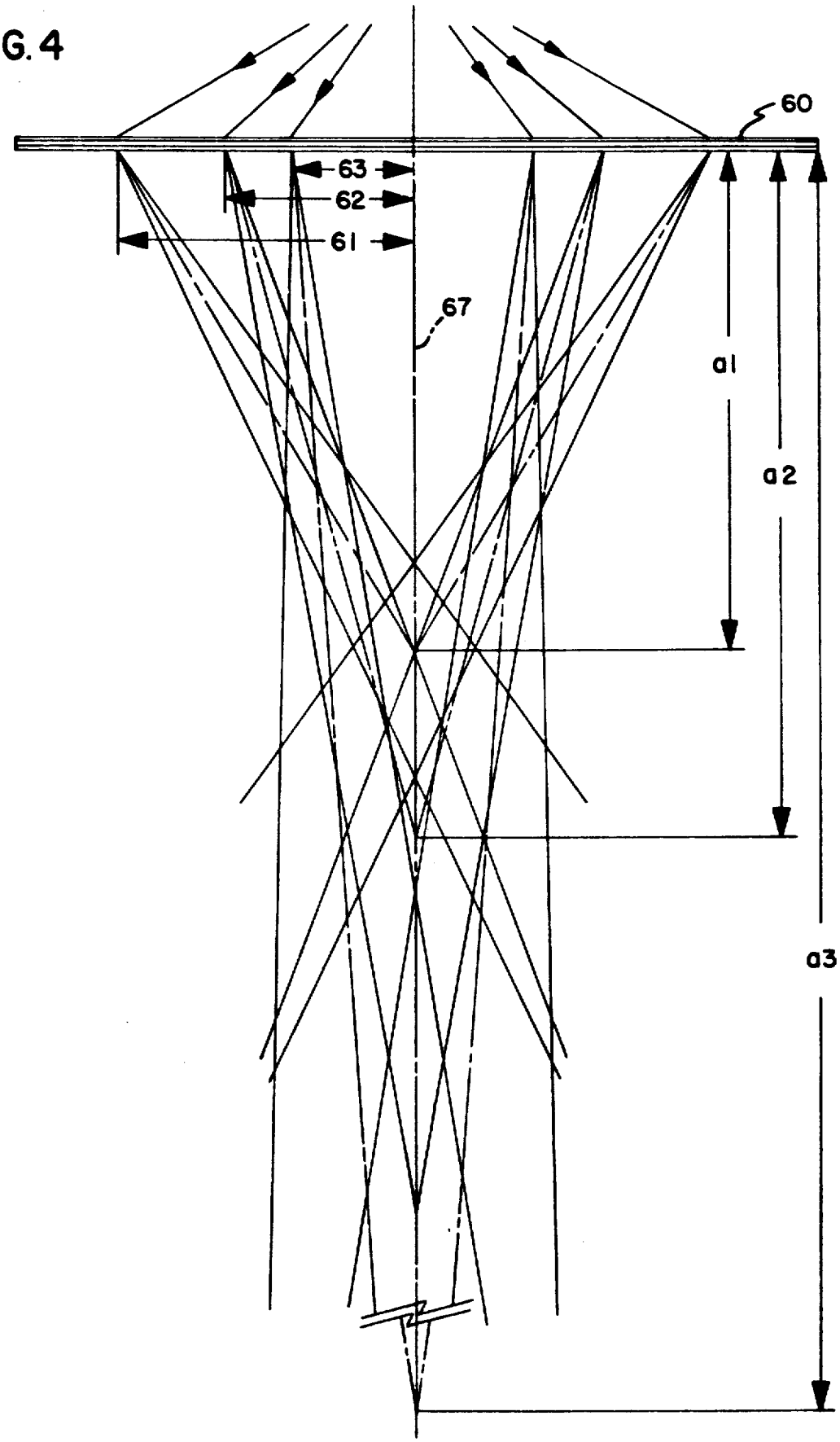
FIG. 4 shows a schematic representation of the path of the rays for individual light beams after passing through the Fresnel lens.

In the catadioptric region 62 of the Fresnel lens 60, the light rays occurring there from the reflector 54 are deflected by a series of annularly-constructed prisms 65 (FIG. 3). The flank inclinations a, b and the height H of the annular prisms of the Fresnel lens 60 are selected such that in the operating field an approximately homogeneous distribution of illumination intensities is obtained, even over a predetermined depth region, which will be explained in more detail with the aid of FIG. 4.

Hence, for example in accordance with FIG. 3, rays 68 are deflected from the reflector 54 into rays 70 such that they strike against inclined surfaces 96 of the prism rings 65 and are diffused into the material of the Fresnel lens 60. Within the Fresnel lens 60, the refracted ray 100 runs up to the back wall of the oppositely-located inclined prism surface 98 and is totally reflected there so that these light rays 102 first run on further in the material of the Fresnel lens 60, and finally come out in the direction toward the operating field as rays 104. In the same way, rays 84, from arbitrary places of the reflector 54, are diffracted in the direction of the ray 86 toward an inclined surface 96 of the prism rings. The outwardly inclined flanks 96 of the catadioptric annular prisms 65 become steeper with increasing distance from the optical axis 67. The corresponding flank inclination, $\alpha$, therefore increases toward the rim of the Fresnel lens 60. The upper edges of the annular prisms 65 become lower toward the rim of the Fresnel lens 60 and the height H of the annular prisms 65 therefore decreases correspondingly toward the rim, so that all radiation passing in this catadioptric rim region in spite of the low structural height, i.e. the short distance 69 from the reflector 54 to the Fresnel lens 60, and in spite of the different diameters, is diffracted into the Fresnel lens 60. Likewise, the flanks 98 directed toward the operating axis 67 of the catadioptric prisms 65, at which a total reflection occurs, become relatively flatter with increasing distance from the optical axis 67, the corresponding flank inclination, $\beta$, therefore decreases toward the rim. In this manner, the spotlight attains, from the catadioptric region 62 of the Fresnel lens 60, a desired ray pattern as will be laid out in more detail with the aid of FIG. 4, 5 and 6.

In the dioptric central region 64 of the Fresnel lens, rays 74 coming from the coil 66 of the light source 50, or rays 76, 78, 80, 82 reflected via the counter reflector 52 and the reflector 54, strike against the flanks 90 of the annular prisms 63' of the Fresnel disk 63 inserted toward the incident light side. From the flanks 90 of the annular prisms 63' directed toward the radiating side, the rays are deflected in the intermediate space 93 that is available between the top Fresnel disk 63 and the throughgoing disk 61. The rays then strike against oppositely inclined flanks 92 of the annular prisms 61' of the throughgoing Fresnel disk 61 directed toward the light source 50. The inclination of oppositely-lying flanks 90 and 92 to the horizontal is in each case different enough so that the radiation 94 from the dioptric central region 64 occurs almost axis-parallel to the optical axis of the Fresnel lens 60; compare in particular FIG. 4. The flanks 92 of the throughgoing Fresnel disk 61 inclined upwardly toward the optical axis have a slope that increases with increasing distance from the optical axis 67. Likewise, the flanks 90 of the annular prisms 63' of the Fresnel disk 63 directed downwardly toward the optical axis 67 display an increasing slope with increasing distance from the optical axis 67.

The special configuration of the annular prisms 65, respectively 63', 61' and the selected flank slopes, $\alpha$, $\beta$ cause the light beams coming from the Fresnel lens to cut the optical axis 67 at a distance a from the Fresnel lens that is all the greater the shorter the distance b, the distance between where the light beams emanate from the Fresnel lens 60 and the optical axis 67. Thus, the light beams that come out at the rim of the Fresnel lens 60 are most strongly refracted toward the optical axis and cut the optical axis 67 at the distance a1. The represented center beam comes out from the Fresnel lens 60 at the distance b2 from the optical axis and cuts the optical axis at the distance a2. The beam of light coming out from the dioptric region of the Fresnel lens 60 near the optical axis 67 at the distance b3, has an external ray that runs almost parallel to the optical axis, the middle ray cuts the optical axis 67 at a great distance a3 from the Fresnel lens 60. The distances a1, a2, a3 give the point of intersection of each center ray of the light beam of concern with the optical axis 67. Achieved by the different focusing of the different light beams is that a homogeneous light intensity is possible over a relatively wide range of depths, and therewith, a homogeneous illumination of a deep surgical wound is possible. Undesired variations in light distribution are to a great extent eliminated.

Figure 5A:
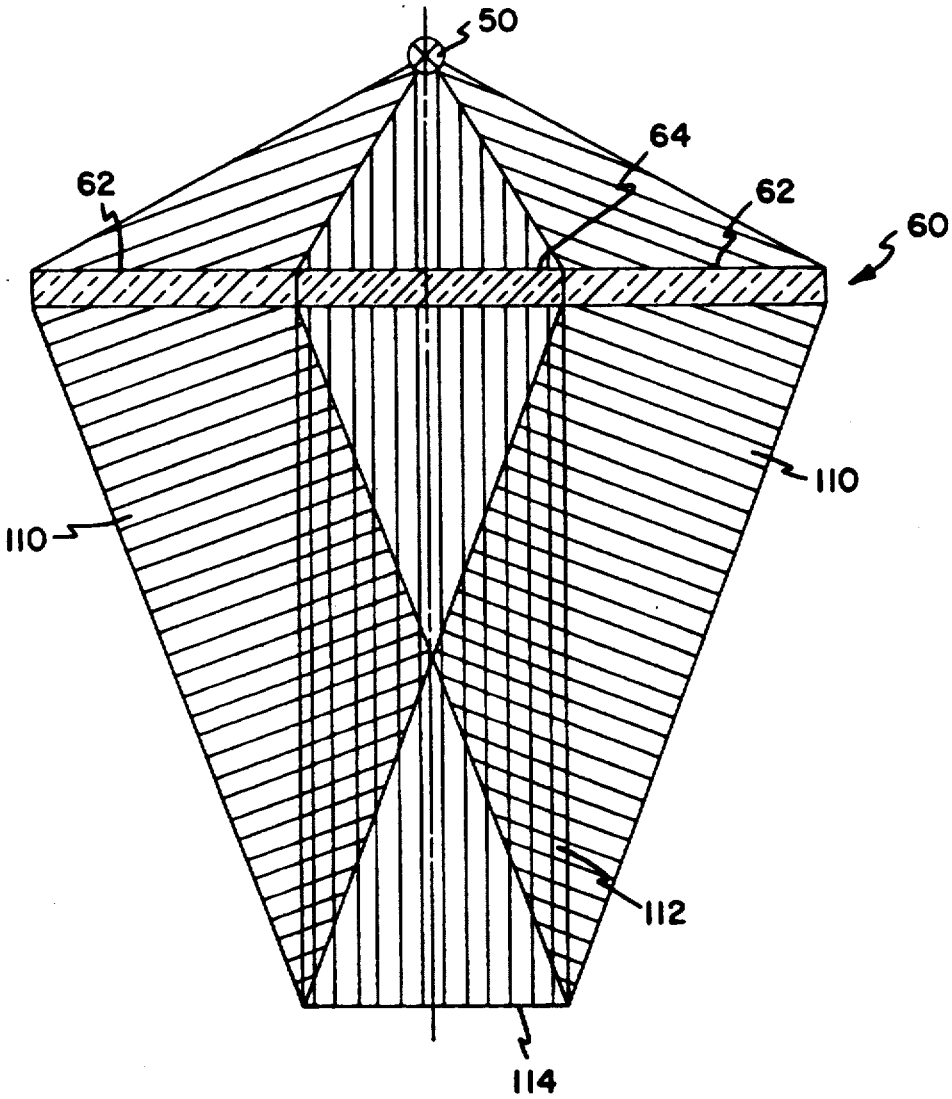
FIG. 5A and 5B shows a greatly simplified representation of light conduction from an individual spotlight into a small illuminated field.
Figure 5B:
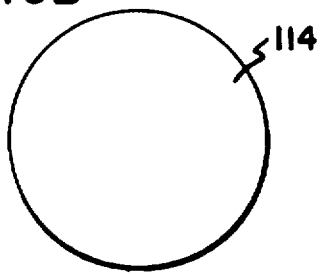
Figure 6A:
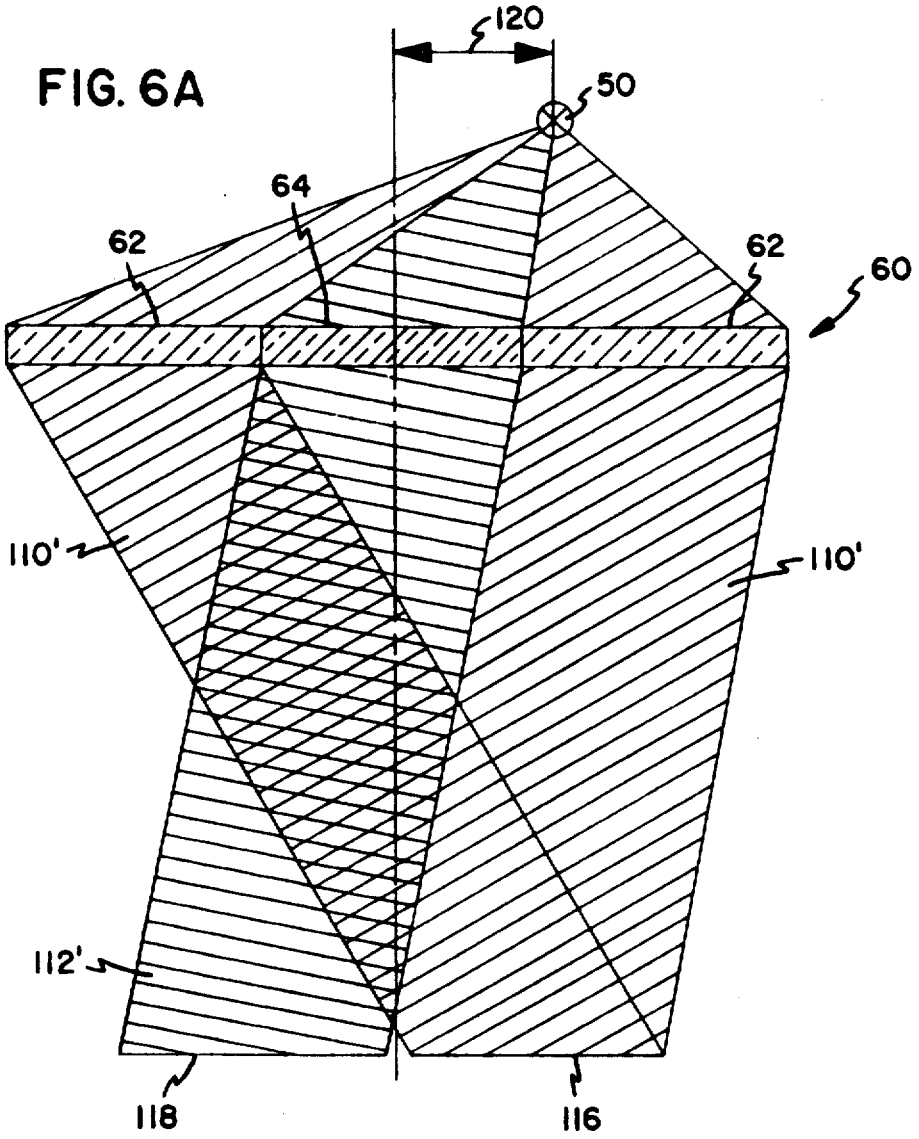
FIG. 6A and 6B shows a representation similar to the one in FIG. 5 for light conduction from an individual spotlight into a large illuminated operating field.
Figure 6B:
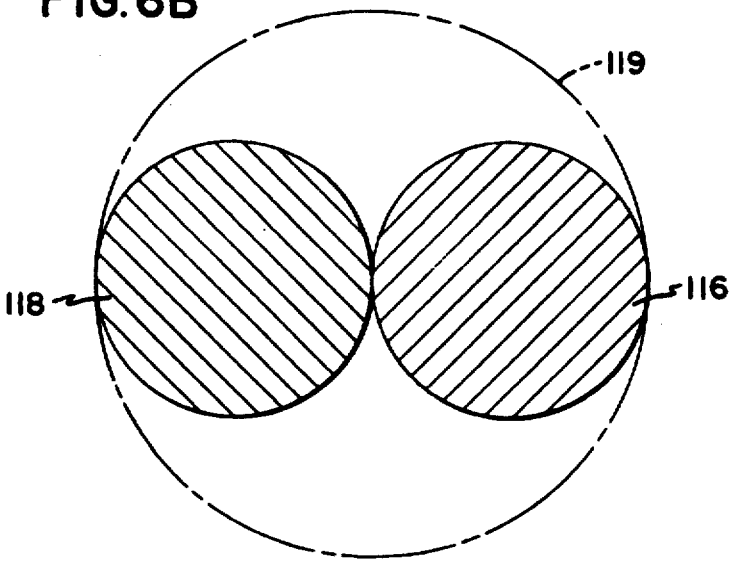

Represented schematically in FIG. 5A and 5B is the homogeneity in the illuminated operating field 114 that is achievable by means of the Fresnel lens 60 with its catadioptric region 62 and dioptric region 64 for an ideal case of exact focusing of the lamp 50 in the optical system. Resulting under an individual spotlight 25 is a concentrically illuminated small field of operation 114, by superimposing the ray guide 112 in the dioptric region 64 in the center with the ray guide 110 in the catadioptric region 62 out from the rim.

Figure 2:
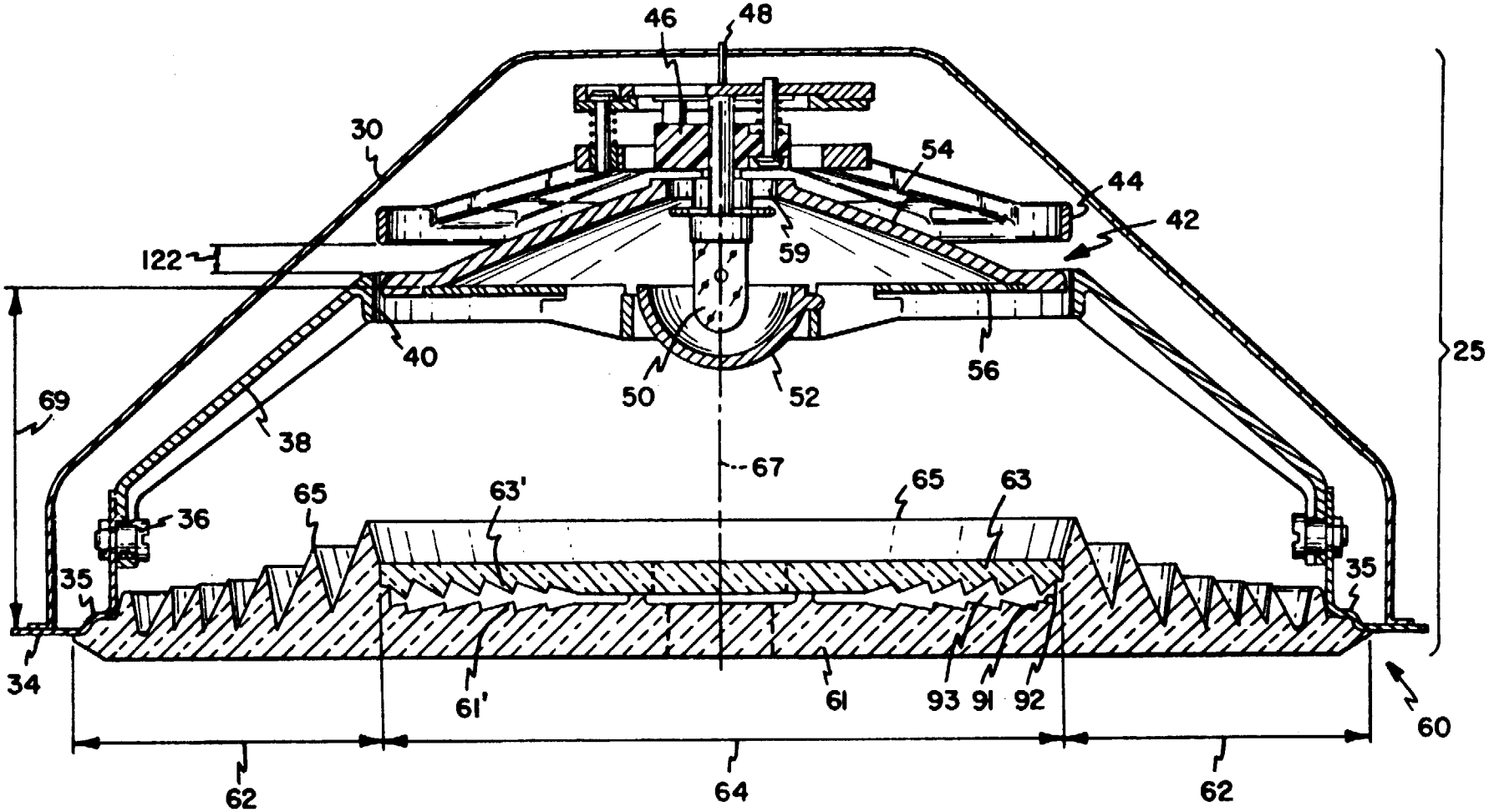
FIG. 2 shows a schematic, sectional representation of an individual spotlight of the new operating light.

Now, in accordance with the invention, the entire ray-generating and reflector system 42 is movable relative to the fixed Fresnel lens 60, which is indicated in FIG. 2 by a movement gap 122 and in FIG. 6 by a lateral deflection 120 of the lamp 50.

Should there occur in the movement gap 122 a short stroke upwardly or downwardly in the direction of the optical axis 67 of the movable system, this would mean, as a change in the distance relative to the fixed Fresnel lens system 60, a broadening or narrowing of the illuminated field. A tilting in the direction of the displacement 122 (FIG. 6) of the lamp 50, with its reflector system made up of counter reflector 52 and reflector 54 with filter disk 56, would result in a pushing apart of the ray pattern 110' in the catadioptric region 62 with a radiation field 116 resulting therefrom. The radiation field 118 is generated by the ray pattern 112' under the dioptric region 64, FIG. 6A. When a tilting of this sort takes place in a three-eye operating light, an operating light 10 with three individual spotlights 25, operating simultaneously and uniformly and which can be accomplished by a simple mechanism, there then would result a large lighted field with an enveloping circle 119, FIG. 6B. Naturally, it is possible to obtain a greater homogeneity in the operating field with a larger number of individual spotlights 25 in an operating light, with the same mutual mobility or tiltability of the lamp reflector system 42 relative to the fixed Fresnel lens system. This type of adjustability, while retaining homogeneity of light distribution and good depth illumination in deep surgical wounds is achievable only through the combination with the Fresnel lenses.

Figure 7:
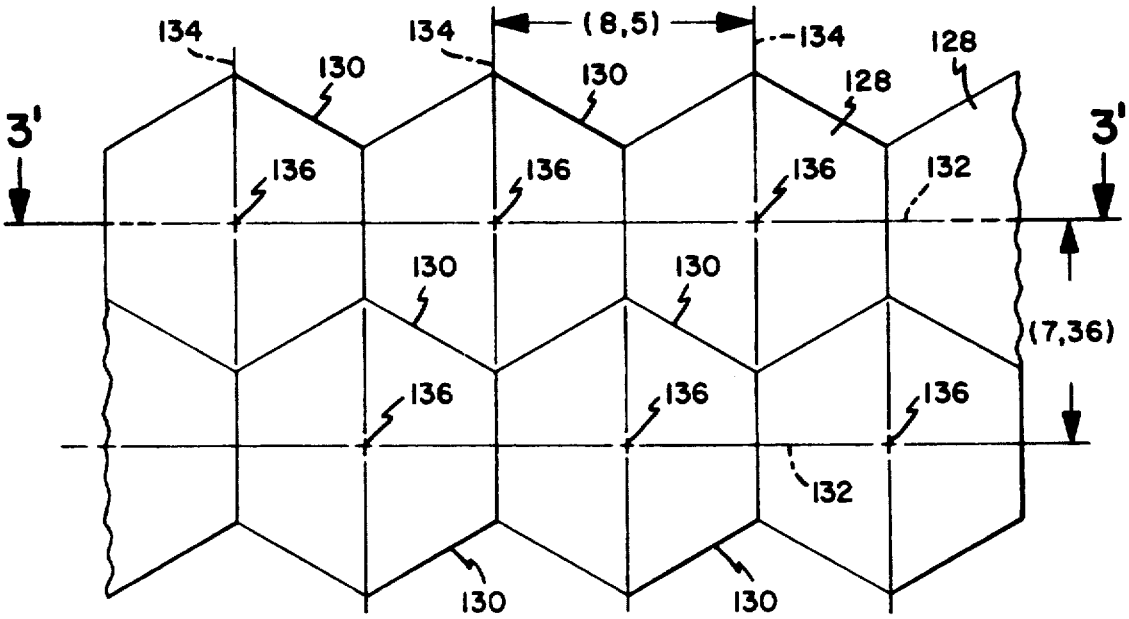
FIG. 7 shows an enlarged view onto a scattering structure of the Fresnel lens.

Instead of a smooth external surface, which when viewed from the top, produces a picture of concentric rings occasioned by the Fresnel structure, the Fresnel lens 60 is given as a scattering layer, a honeycomb structure, as becomes clear from the enlarged cutout view from FIG. 3 or in FIG. 7. The top view onto a section 122 follows in the direction of the arrow 124. Here, in the representation of FIG. 7 and 8, a greatly enlarged scale is used as compared to FIG. 3. While the diameter of the individual spotlight comes to about 20 to 30 cm, the section in FIG. 7 and/or 8 shows a width of only about 2.6 cm.

It is essential that the scattering structure be small relative to the annular prisms 65, 90, 92 of the Fresnel lens 60 and that the structural limits of the scattering structure cross, in as much as possible, the structural lines of the lens glass.

As can be seen from FIG. 7, the scattering structure consists of polygons 128. Preferably provided are hexagons that are disposed with their sides 130 up against each other in rectilinearly-aligned, perpendicularly-crossing axes 132, 134. We are dealing here with a very small-space structure (polygonal diameter for example 7.36 to 8.5 mm), as compared with the diameter of the Fresnel lens 60.

Figure 8:
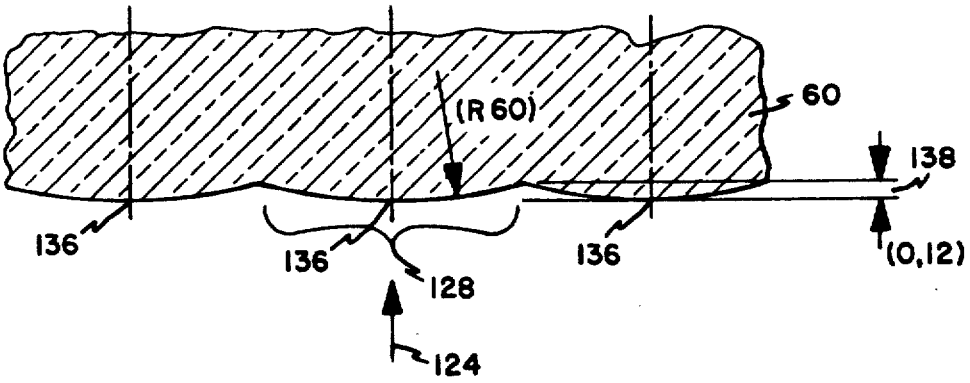
FIG. 8 shows a cut along the line 3'—' in FIG. 7.

FIG. 8 shows a cut through the scattering structure represented in FIG. 7, along the cut axis 3'—3'. The individual hexagons display a bulge 138 toward the center 136, whereby arising at the hexagonal edges 130 is an obtuse angle. The depth of flexure is in the magnitude of 0.1 mm.

The bulge has an arc radius of 60 mm over the center 136. All dimensions given in the drawing of FIG. 7 and 8 are mm-dimensions.

Instead of an outwardly-directed, arched honeycomb structure, also capable of being made in the surface of the Fresnel lens 60 are like down-warpings.

Obtained by means of several individual spotlights in an operating light is a good homogeneity of the lighting field and good depth illumination. The size of the field can be regulated with other measures. Also, contrast formation improves considerably by means of the new honeycomb structure. Based on DIN 2035, shadiness has been determined to be greater than 50% and deep shadiness greater than 30%.

We claim:

1. An operation light (10) comprising at least one spotlight (25), said spotlight having a light source (50) that is shielded in the direction of radiation by a counter reflector (52), a stream of light reflected by said counter reflector (52) is focused by a principal reflector (54) onto an optical system closing off the spotlight in the direction of radiation, said optical system includes a Fresnel lens (60) having a dioptric central region (64) and a catadioptric edge region (62) centered on an optical axis (67) therethrough, said regions including annular prisms (65; 61', 63' configured such that light beams of the stream of light emanating from the Fresnel lens (60) all cut the optical axis (67) a distance (a) away from the fresnel lens, said distance from the Fresnel Lens (60) being greater with the shortening of the distance (b) between where the light beams emanate from the Fresnel lens (60) and where the optical axis (67) intersects with the Fresnel lens (60).

2. An operating light according to claim 1, characterized by the fact that the principal reflector (54) is a hyperboloid having a reflection coating (53) deposited on a glass body extending from an apex to a rim.

3. An operating light according to claim 2, characterized by the fact that the reflection coating (53) on the principal reflector (54) substantially reflects visible light and substantially allows infrared radiation to pass therethrough.

4. An operating light according to claim 3, characterized by the fact that the reflection coating (53) of the principal reflector (54) is deposited thicker at the rim of the principal reflector than at the apex of the principal reflector.

5. An operating light according to claim 2, characterized by the fact that the diameter of the principal reflector (54) is smaller than the diameter of the Fresnel lens (60).

6. An operating light according to claim 3, characterized by the fact that the reflection coating (53) is deposited on an inner side of the principal reflector towards said light source, while an outer side of said principal reflector includes a surface (57) for scattering the infrared radiation that has passed therethrough.

7. An operating light according to claim 2, characterized by the fact that a filtering disk (56) which extends radially inward from the rim of the principal reflector (54) in a horizontal reflector output plane.

8. An operating light according to claim 1, characterized by the fact that the Fresnel lens (60) comprises a throughgoing basic disk (61) that displays in the catadioptric edge region (62) first annular prisms (65) having a relatively large triangular shaped cross section and first and second flanks (96, 98) pointing toward the principal reflector (54) defining top apex rings of the first annular prisms (65) where the first and second flanks (96, 98) intersect, and includes in the dioptric central region (64) second annular prisms (61') having a relatively small triangular-shaped cross section and third and fourth flanks (91, 92) pointing toward the reflector (54), said Fresnel lens (60) further comprising a second Fresnel disk (63) disposed in the dioptric central region (64) including third annular prisms (63') having a relatively small triangular-shaped cross section and fifth and sixth flanks (90, 90') directed away from the principal reflector (54), the third annular prisms (63') of the second Fresnel disk (63) lie opposite to the second annular prisms (61') of the throughgoing basic disk (61), the second Fresnel disk (63) together with the throughgoing basic disk (61) and an air gap (93) enclosed therebetween form the dioptric central region (64) of the Fresnel lens (60).

9. An operating light according to claim 8, characterized by the fact that the top apex rings of the first annular prisms (65) of the catadioptric edge region (62) run lower with respect to the principal reflector (54), in step-fashion, with increasing distance of the top apex rings from the optical axis (67).

10. An operating light according to claim 8, characterized by the fact that the first flanks (96) of the first annular prisms (65) of the catadioptric edge region (62) which are inclined toward the optical axis (67) are disposed more steeply with increasing distance of the first flanks (96) from the optical center axis (67) while the radially, outwardly inclined second flanks (98) of the first annular prisms (65) have a lesser incline with increasing distance of the second flanks (98) from the optical axis (67).

11. An operating light according to claim 8, characterized by the fact that the fourth and fifth flanks (92, 90) of the second and third annular prisms (61', 63'), respectively, lie opposed to one another and which, on the light source side (90), lie more toward the horizontal than on the light-output side (92) so that light beams emanate from the dioptric central region (64) almost parallel to the optical axis (67).

12. An operating light according to claim 8, characterized by the fact that the fourth and fifth flanks (92, 90) of the second and third annular prisms (61', 63'), respectively, form a growing angle to the horizontal with increasing distance from the optical axis (67).

13. An operating light according to claim 1, characterized by the fact that the light source (50), counter reflector (52) and principal reflector (54) form a structural unit (42) which, compared to the Fresnel lens (60) that is rigidly joined with a housing (26), is disposed in movable fashion.

14. An operating light according to claim 13, characterized by the fact that the structural unit (42) is tiltable.

15. An operating light according to claim 14, characterized by the fact that the structural unit (42) is movable laterally with regard to the optical axis (67).

16. An operating light according to claim 13, characterized by the fact that the movement of the structural unit (42), having a plurality of individual spotlights (25) coupled with one another inside said housing (26), occurs symmetrically to the optical axis (67).

17. An operating light according to claim 1, characterized by the fact that said at least one spotlight (25) is covered on the side lying opposite to the light-radiating side by a removable cover (30).

18. An operating light according to claim 1, characterized by the fact the Fresnel lens (60) displays an auxiliary scattering structure.

19. An operating light according to claim 18, characterized by the fact that the auxiliary scattering structure comprises polygons (128) that display a bulge (138) toward the center (136) of the polygon.

20. An operating light according to claim 19, characterized by the fact that the polygons (128) are hexagons that are disposed tightly against one another in rectiliniarly-directed axes (132, 134).

21. An operating light according to claim 18, characterized by the fact that the scattering structure is disposed on the surface of the Fresnel lens (60) turned away from the light source.

* * * * *

UNITED STATES PATENT AND TRADEMARK OFFICE

CERTIFICATE OF CORRECTION

PATENT NO. : 5,128,848

DATED : July 7, 1992

INVENTOR(S) : Peter Enders et al.

It is certified that error appears in the above-identified patent and that said Letters Patent is hereby corrected as shown below:

ON THE TITLE PAGE:

In [30], delete "8903955(U)" and insert --8903955.6(U)-- therefor.

In column 3, line 53, delete "3'-'" and insert --3'-3'-- therefor.

In column 8, line 25, delete "operation" and insert --operating-- therefor.

In column 8, line 38, delete "fresnel" and insert --Fresnel-- therefor.

Signed and Sealed this

Eleventh Day of January, 1994

Bruce Lehman

BRUCE LEHMAN

*Commissioner of Patents and Trademarks*

*Attest:*

*Attesting Officer*